US005645180A

United States Patent [19]

Zaguroli, Jr.

[11] Patent Number: 5,645,180

[45] Date of Patent: Jul. 8, 1997

[54] FLOOR MOUNTED ROTATABLE JIB CRANE

[75] Inventor: James Zaguroli, Jr., Drayton Plains, Mich.

[73] Assignee: Knight Industries, Inc., Auburn Hills, Mich.

[21] Appl. No.: 329,243

[22] Filed: Oct. 26, 1994

[51] Int. Cl.[6] ..... B66C 23/84

[52] U.S. Cl. ..... 212/253; 212/223; 212/260

[58] Field of Search ..... 212/179, 180, 212/230, 231, 253, 299, 306, 347, 348, 287, 288, 289, 247, 248, 223, 255, 260

[56] References Cited

U.S. PATENT DOCUMENTS

| | | | |
|---|---|---|---|
| 1,399,351 | 12/1921 | Lee | 212/901 |
| 2,446,220 | 8/1948 | Erdahl | 212/299 |
| 2,571,858 | 10/1951 | Garland | 212/231 |
| 2,956,691 | 10/1960 | Fangman | 212/231 |
| 3,129,821 | 4/1964 | Graham et al. | 212/230 |
| 3,315,820 | 4/1967 | Stauffer | 212/288 |

FOREIGN PATENT DOCUMENTS

| | | | |
|---|---|---|---|
| 1060154 | 1/1967 | United Kingdom | 212/230 |

*Primary Examiner*—Thomas J. Brahan
*Attorney, Agent, or Firm*—John R. Benefiel

[57] ABSTRACT

A jib gantry is disclosed which has a connection between the upper end of a mast and a horizontally extending boom which allows tilting adjustment, which is secured in any adjusted position. The boom is hollow and slotted so as to be fixed at any point along the slot to the upper end of the mast. The lower end of the mast is rotatable within an upright pipe to be rotated to swing the boom through complete revolutions.

6 Claims, 4 Drawing Sheets

FLOOR MOUNTED ROTATABLE JIB CRANE

FIELD OF THE INVENTION

This invention concerns jib cranes and more particularly jib cranes having a vertical mast which is supported for full 360° rotation.

BACKGROUND OF THE INVENTION

There has heretofore been provided floor mounted rotatable jib cranes in which a vertical mast is supported for rotation within a pipe fastened to the floor or foundation. A jib or boom is secured to the upper end of the mast projecting horizontally and swinging in a horizontal arc as the mast is rotated.

A traveling hoist is supported by the horizontal boom. The hoist is mounted so as to be able to traverse along the length of the boom.

In such apparatus, it is critical that the boom extend in a true horizontal plane inasmuch as any out of level condition would possibly allow the traversing hoist to roll out of position due to a horizontal component of the load thus acting to urge the hoist and load to advance in either direction on the boom.

Also, the weight of an out of level boom itself could also cause self-induced rotation of the mast. U.S. Pat. No. 4,688,688 issued on Aug. 25, 1986 for a "Jib Crane Arrangement Having a Rotatable Mast" describes such a rotatable floor mounted jib crane in which the mast is rotatably mounted within a floor anchored pipe.

U.S. Pat. No. 4,511,048 issued on Apr. 16, 1985 for a "Jib Crane System Having a Rotatable Mast" describes an adjustable bearing arrangement for such apparatus for the purpose of maintaining and adjusting the plumb condition of the mast. This arrangement does not allow compensation for varying hoist loading conditions which can cause the boom to be deflected out of level or for other conditions which cause the boom level to be affected without any loss of out-of-plumb condition of the mast.

In addition, the bearings are relatively difficult to adjust, inasmuch as the bearing loading is effected by these adjustments limiting the extent of adjustment available for setting a plumb condition.

The above-described prior art jib crane arrangements have provided a 360° rotation capability for booms affixed to the mast. For very long length booms, a cable and turnbuckle are attached to the outer end of the boom and the upper end of the mast in order to resist load-induced sagging of the boom. In such arrangements, the pivoting heretofore provided has been comprised of pivots of the boom to the mast and the anchoring point of the turnbuckle cable combination.

Such arrangement does not allow for 360° rotation nor the low friction arrangement of a roller bearing mast support.

Accordingly, it is an object of the present invention to provide a jib crane configuration in which the horizontal boom may be easily adjusted to a level condition.

It is another object of the present invention to provide a 360° rotation jib crane for long-length booms equipped with a turnbuckle cable boom support.

SUMMARY OF THE INVENTION

The above objects are achieved by a depending post fixed relative to one end of a horizontal boom and extending downwardly into a hollow upper end of a vertical mast, with a clearance space therebetween. The post bottom end is pivoted to the mast to allow limited tilting. An arrangement for holding the boom in an adjusted tilted position allows an adjustment to horizontal of the boom. This arrangement may comprise a depending tab extending downwardly from and fixed relative to the boom adjacent the exterior of the mast, and a threaded bolt advanced through a threaded hole in the tab to bear against the mast upper end.

The boom is adjustably mounted on the mast by a clamping arrangement including an upper plate inside the boom, a lower plate outside the boom and having the depending post and tab integral therewith selectively clamping the boom at any lengthwise adjusted position of the boom.

The square sectioned mast is rotatably supported in a stanchion pipe by sets of rollers arranged about the perimeter thereof, and a thrust washer on the bottom end.

In a second embodiment, a cable and turnbuckle are attached between the boom outer end and the top of a mast.

DETAILED DESCRIPTION

In the following detailed description, certain specific terminology will be employed for the sake of clarity and a particular embodiment described in accordance with the requirements of 35 USC 112, but it is to be understood that the same is not intended to be limiting and should not be so construed inasmuch as the invention is capable of taking many forms and variations within the scope of the appended claims.

Figure 1:
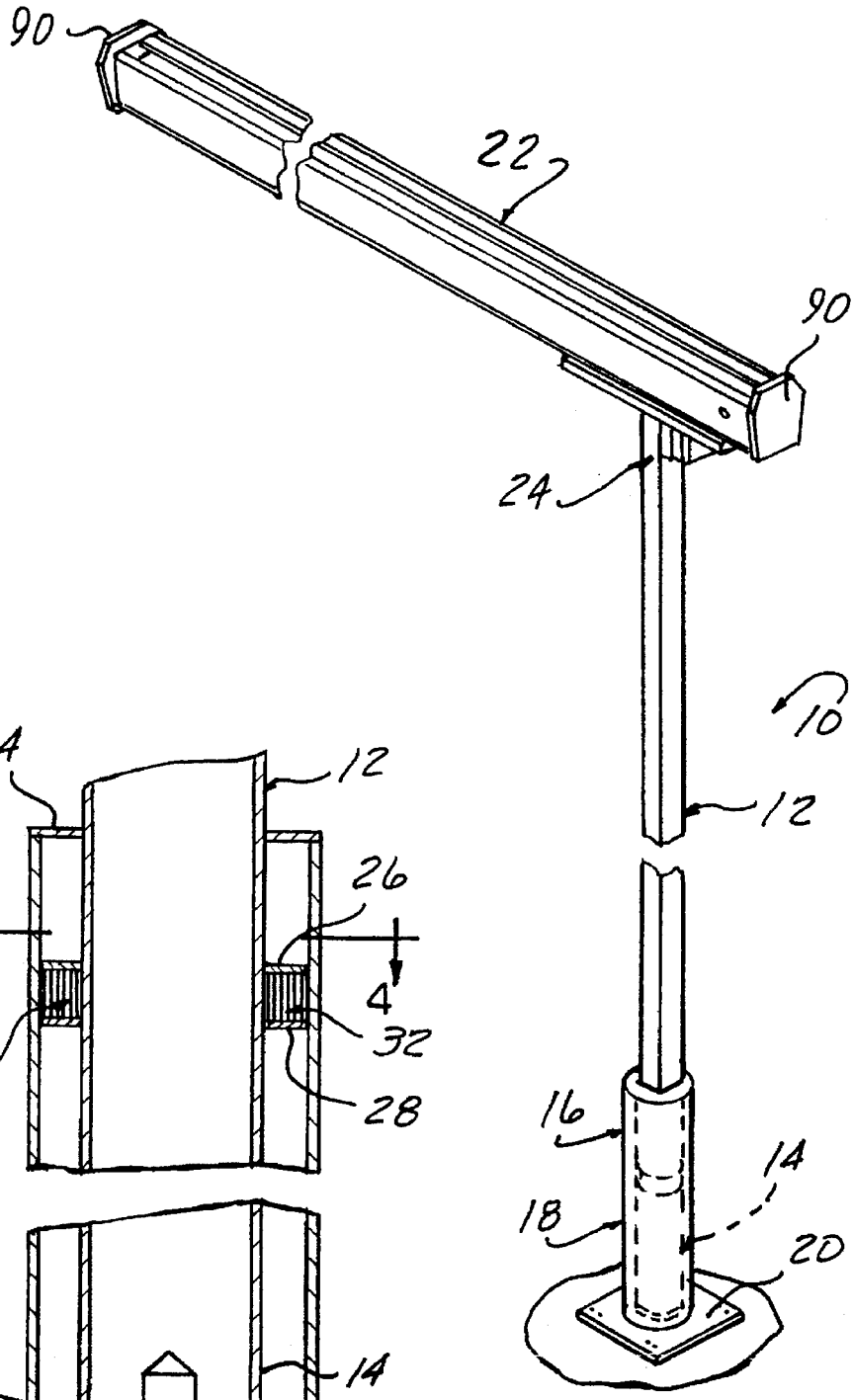
FIG. 1 is a perspective view of a jib crane according to the present invention with the mast and boom partially broken away.

Referring to the drawings and particularly FIG. 1, the jib gantry 10 according to the present invention includes an upwardly extending mast 12 here comprised of a length of square steel tubing having a lower end 14 received within a stanchion 16, comprised of an upright pipe 18 affixed to a base plate 20 which is in turn bolted or otherwise secured to the floor or foundation. As will be described hereinafter in further detail, the mast 12 is rotatable within the stanchion 16 such as to enable complete revolution therein.

Affixed to the upper end 16 of the mast 12 is a horizontally extending elongated boom 22 which is adapted to provide a linear support for a traveling hoist (not shown in the drawings).

Figure 3:
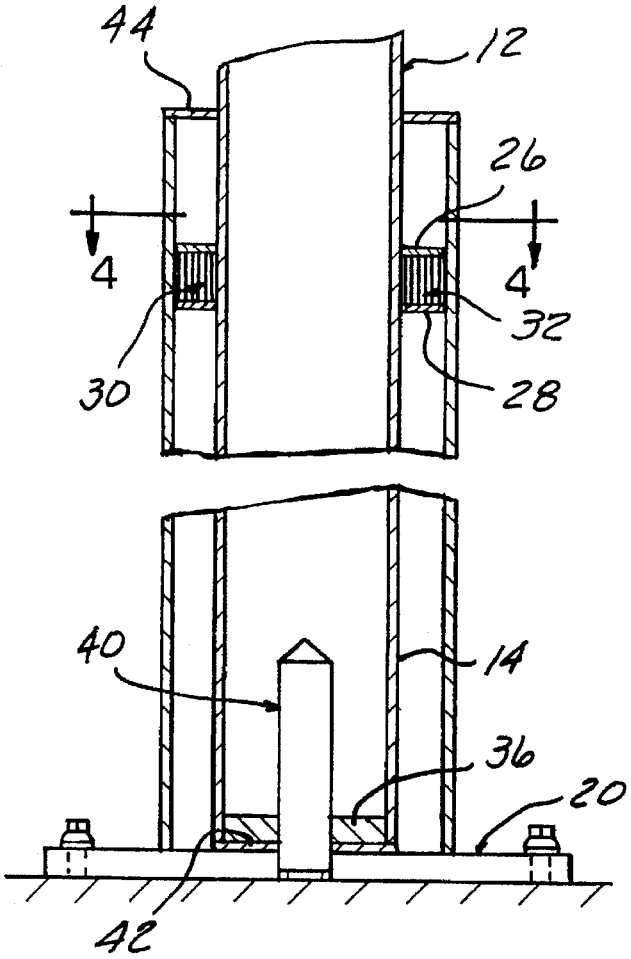
FIG. 3 is a sectional view of the mast rotatable mount, partially broken away.
Figure 2:
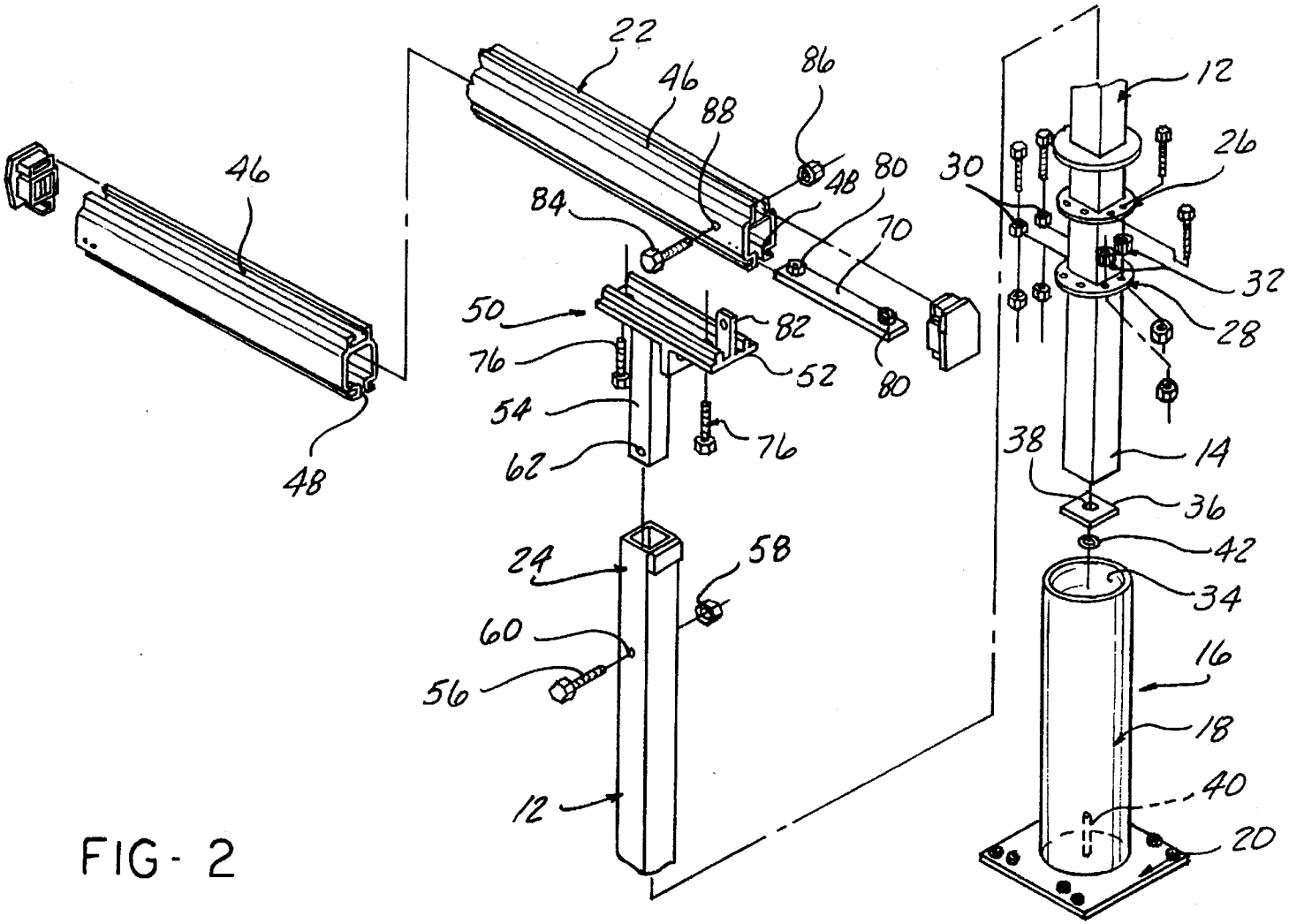
FIG. 2 is an exploded perspective view of the jib crane is shown in FIG. 1.
Figure 4:
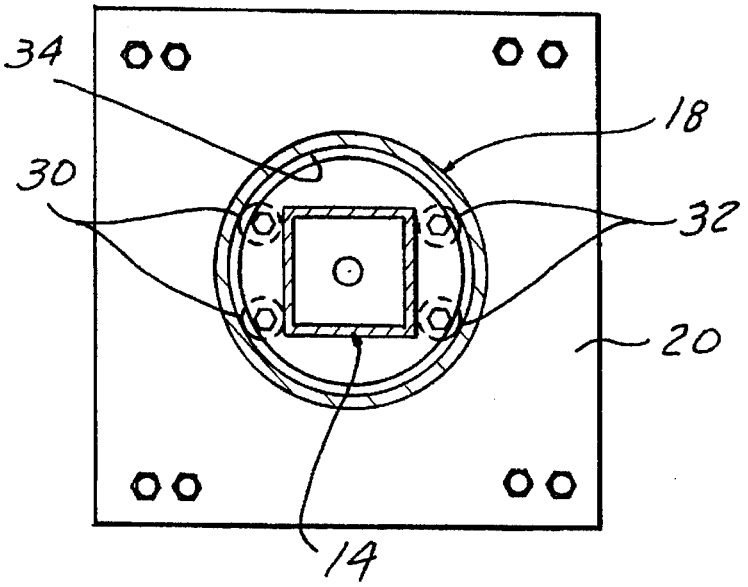
FIG. 4 is a transverse sectional view taken through the mast mounting shown in FIG. 3.
Figure 6:
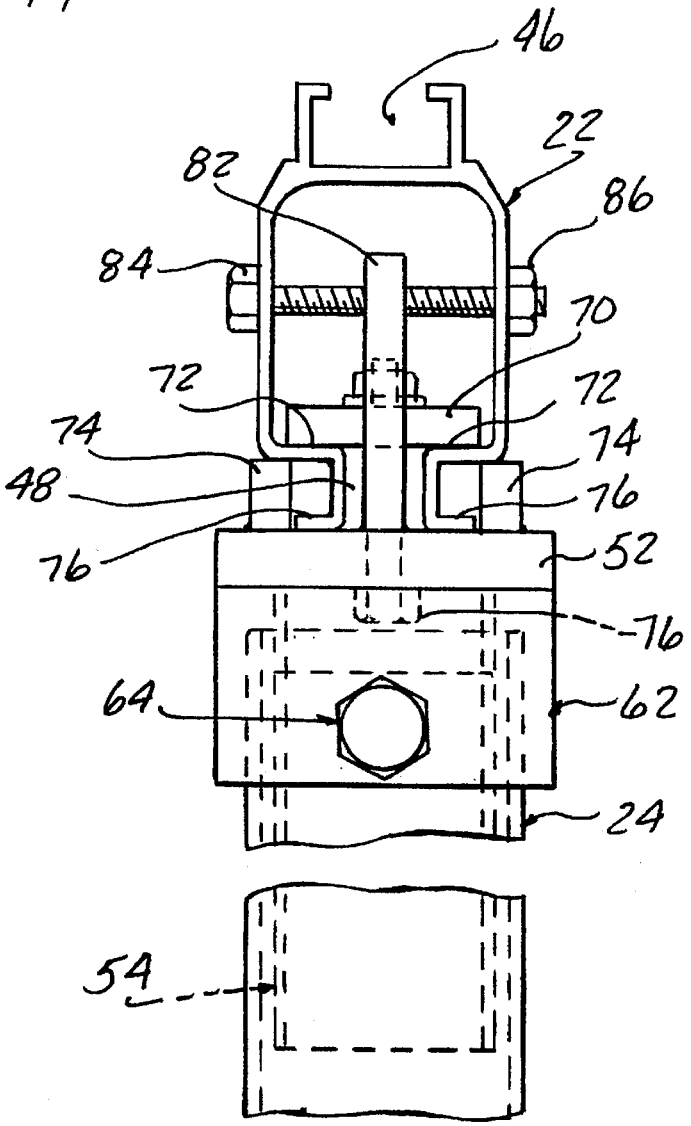
FIG. 6 is an end view of the boom and a fragmentary portion of the upper mast end.

The rotary mounting details can be seen in FIGS. 2, 3, and 4. The lower end of the mast 12 has affixed thereto a pair of spaced roller mounting plates 26 and 28 shown in a more widely spaced relationship in FIG. 2.

Two pairs of rollers 30 and 32 are mounted by means of bolts and nuts on opposite sides of the lower end 14 of the mast 12. The roller pairs 30 and 32 protrude beyond the bearing plates 26 and 28 such as to be engageable with the inside 34 of the stanchion pipe 18 and thus provide the rotatable support.

The very lowermost end 14 of the mast 12 has a plate 36 welded therein having a hole 38 which receives a locator pin 40 extending upwardly from the base plate 20 and within the pipe 18. A thrust bearing 42 is interposed between the plate 36 and the top surface of the base plate 20 and received over the pin 40 such as to provide a thrust bearing support of the mast 12.

A cover plate 44 is also welded to the exterior of the mast 12 at a location so as to overlie the upper end of the stanchion pipe 18 to prevent the entrance of foreign objects, dirt, etc.

The boom 22 is mounted to the upper end of the mast 12 such as to be slidable at any selected position along the length of the boom 22 and is also angularly adjustable to a degree such as to allow precise leveling of the boom 22 in a horizontal plane.

The boom 22 is comprised of a hollow tubing section having an upper track 46 for receiving a guide for a traveling hoist (not shown).

A bottom located slot 48 extends into the interior of the boom hollow section and allows a releasable clamping mounting of a post fitting 50. The post fitting 50 includes a lower clamping plate portion 52 integral with a downwardly extending post 54, the post 54 being of square cross section and sized such as to be slidably received within the hollow upper end 24 of the mast 12, with a significant clearance therebetween. This clearance allows a limited degree of tilting of the post 54 in the mast 12 about a pivotal connection provided by a bolt 56 secured with a nut 58 passing through a hole 60 in the mast upper end 24 in a corresponding aligned hole 62 in the lower end of the post 54.

Figure 5:
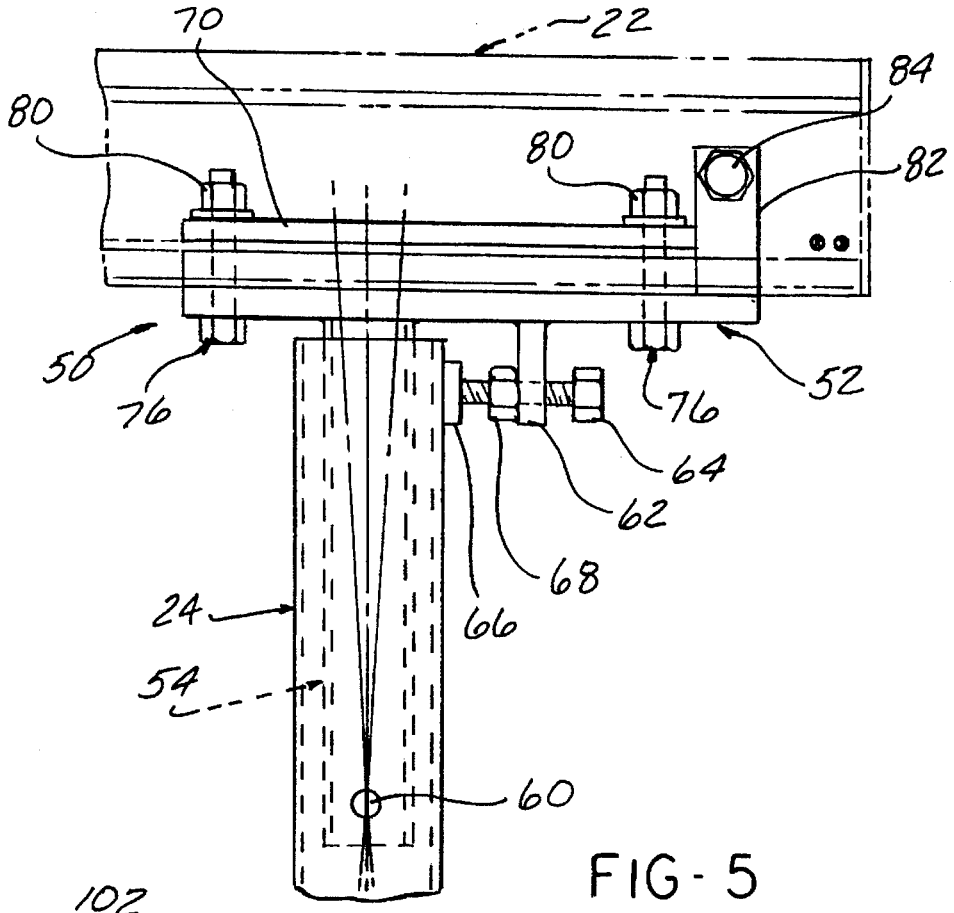
FIG. 5 is an enlarged fragmentary view of the mast-boom connection according to the invention, with the boom portion shown in phantom.
Figure 7:
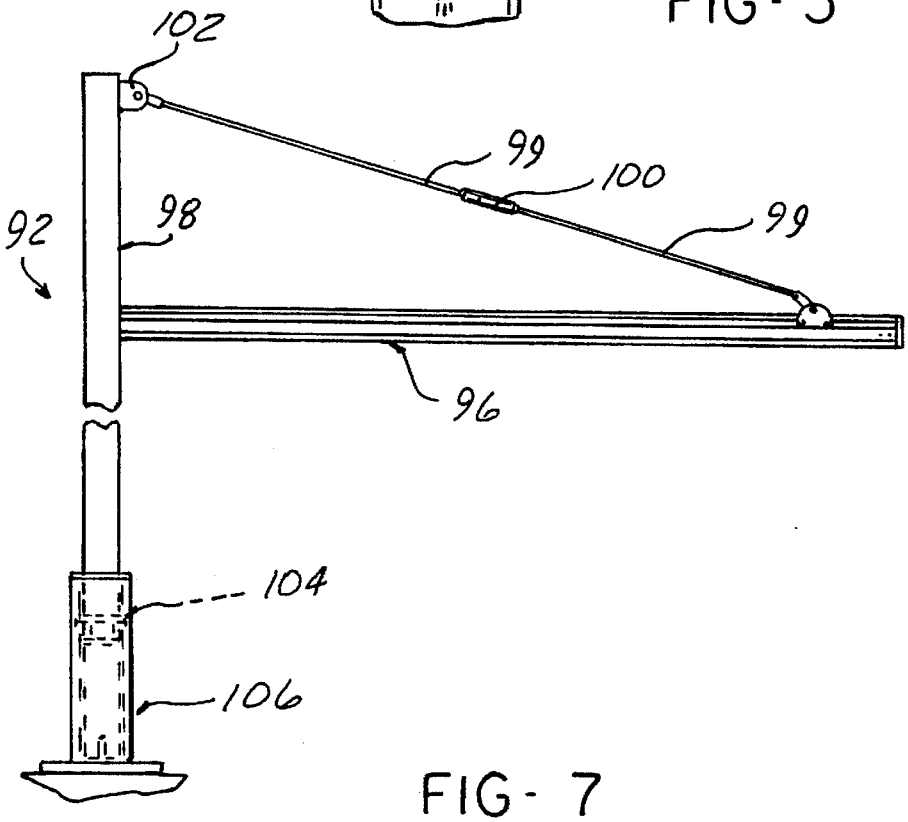
FIG. 7 is a side elevational view of an extended length boom jib crane utilizing a rotatable mast mount according to the embodiment of the jib crane shown in FIGS. 1 through 6.

Securement means are provided for securing the post 54 and mast upper end 24 in any tilted relative position which means consists of a depending structure comprised of a tab 62 welded to the undersurface of the lower clamping plate 52 extending downwardly to be juxtaposed to the very uppermost region of the mast end 24, as shown in FIG. 5.

An elongated element comprised of a bolt 64 is threadably received within and through the structure 62, having an end held in engagement with the mast upper end 24 and against a wear block 66 welded thereto by the overhung weight of the boom 22. A locking nut 68 allows locking of the bolt 64 in any adjusted position.

Thus, the level condition of the boom 22 can be adjusted after installation of the mast 12 in the stanchion 16.

An upper clamping plate 70 is located within the boom 22 against a pair of shoulders 72 formed by the slot 48. A pair of ribs 74 are also affixed or welded to the upper surface of the lower clamping plate 52 such as to confine the out-turned edges 76 of the boom beneath the groove 48.

A pair of bolts 76 pass upwardly within the central region of the lower clamping plate 52 passing through the upper clamping plate 70, secured by means of a pair of weld nuts 80.

This arrangement allows lengthwise adjustment of the boom on the mast 12.

A safety connection is also preferably included comprised of an upwardly extending tab 82 integral with the lower clamping plate 82 passing upwardly into the slot 48 and a cross bolt 84 secured with a nut 86 passing through drilled holes 88 aligned on either side of the boom 22. This positively prevents disconnection of the boom with the mast 12 in the event the clamping plates become loosened inadvertently.

A pair of end caps of molded plastic 90 are provided which may be secured with screws (not shown) received in drilled holes in the opposite ends of the boom 22.

According to another aspect of the present invention, a jib gantry 92 is provided in which an extra long length boom 96 is affixed to a mast 98 at one end, with its opposite end supported by means of cables 99 and turnbuckle 100, the upper cable length affixed at 102 to the upper end of the mast 98.

The lower end of the mast is provided with a roller bearing assembly 104 and a stanchion assembly 106, as in the abovedescribed described embodiment, which allows a 360° rotation of the boom 96. This improves the prior design in which the boom 96 was pinned at its inner end to the mast 98, which allows only a much smaller extent of rotation on the mast. Accordingly, by utilizing the rotary mounting of the mast, a complete 360° rotation is allowed.

I claim:

1. A jib crane comprising:

a vertical mast;

a stanchion comprising an open-ended pipe and support means fixing said pipe in an upright position, said pipe rotatably receiving a lower end of said mast;

an elongated boom adapted to provide support for a traveling hoist, said boom extending horizontally from a hollow upper end of said mast;

adjustable angle connecting means connecting said boom to said upper end of said mast, said connecting means including a depending post and means fixing said post to said boom to extend down therefrom at a fixed angle, said post extending down within said hollow upper end of said mast with a clearance space between said post and the inside of said hollow upper end of said mast, a pivotal connection at a lower end of said post pivotally mounting said post lower end to said mast allowing limited relative tilting of said boom and said post together as a unitary structure about an axis defined by said post pivotal connection to the extent of said clearance space between said post and said inside of said hollow upper end of said mast, and adjustable securement means securing said post and said mast in any relatively tilted position of said post in said upper end of said mast, whereby the angle whereat said boom extends from said mast can be selectively adjusted within the limits of said clearance space.

2. The jib crane according to claim 1 wherein said adjustable securement means comprises a relatively fixed structure extending down from said boom to be juxtaposed opposite said upper end of said mast and an elongated element extending through said structure, and engaging said upper end of said mast to thereby secure the angularly adjusted tilt of said post and upper end of said mast.

3. The jib crane according to claim 2 wherein said elongate element is threaded into said structure to enable adjustment in the lengthwise direction.

4. The jib crane according to claim 3 further including a locking nut on said element and engageable with said fixed structure to lock said adjusted position of said elongate element.

5. The jib crane according to claim 2 wherein said boom is hollow and is formed with a lengthwise-extending slot along the bottom side thereof, forming a pair of inside shoulders, an upper clamping plate disposed within said boom and atop said shoulders, and a lower clamping plate fixed to said post and said relatively fixed structures, said upper and lower clamping plates releasably clamped to said boom with threaded fasteners, extending through said slot, whereby the lengthwise position of said boom on said mast can be adjusted by release of said clamping plates and sliding of said boom.

6. The jib crane according to claim 5 further including a safety tab fixed to said lower clamping plate and extending upward through said slot, and a pin extending through said mast and saftety tab to positively lock said boom to said mast upper end.

* * * * *

UNITED STATES PATENT AND TRADEMARK OFFICE

CERTIFICATE OF CORRECTION

PATENT NO. : 5,645,180
DATED : July 8, 1997
INVENTOR(S) : James Zaguroli, Jr.

It is certified that error appears in the above-indentified patent and that said Letters Patent is hereby corrected as shown below:

Column 1, line 22, delete "thus".

Column 2, line 24, "crane is" should be --crane--.

Column 4, line 25, "abovedescribed described" should be --above-described--.

Signed and Sealed this

Second Day of September, 1997

*Attest:*

*Attesting Officer*

BRUCE LEHMAN

*Commissioner of Patents and Trademarks*